US006736377B1

(12) United States Patent
Chien

(10) Patent No.: US 6,736,377 B1
(45) Date of Patent: May 18, 2004

(54) STRUCTURE FOR AN OXYGEN ADDING AND AERATION DEVICE

(75) Inventor: Huan-Jan Chien, Hsinchui (TW)

(73) Assignee: PolyVane Technology Corp., Hsinchu (TW)

( * ) Notice: Subject to any disclaimer, the term of this patent is extended or adjusted under 35 U.S.C. 154(b) by 0 days.

(21) Appl. No.: 10/372,953

(22) Filed: Feb. 26, 2003

(51) Int. Cl.[7] ..... B01F 3/04
(52) U.S. Cl. ..... 261/93; 210/221.2
(58) Field of Search ..... 261/87, 91, 93; 209/169, 170; 210/221.2

(56) References Cited

U.S. PATENT DOCUMENTS

| | | | | | |
|---|---|---|---|---|---|
| 1,242,445 | A | * | 10/1917 | Ittner | 261/87 |
| 1,976,956 | A | * | 10/1934 | MacLean | 261/93 |
| 2,246,560 | A | * | 6/1941 | Weinig et al. | 261/93 |
| 2,892,543 | A | * | 6/1959 | Daman | 209/169 |
| 2,966,345 | A | * | 12/1960 | Burgoon et al. | 261/87 |
| 3,202,281 | A | * | 8/1965 | Weston | 209/166 |
| 3,278,170 | A | * | 10/1966 | Moritz | 261/29 |
| 3,393,802 | A | * | 7/1968 | Logue et al. | 209/169 |
| 3,490,996 | A | * | 1/1970 | Kelly, Jr. | 202/234 |
| 3,823,923 | A | * | 7/1974 | Chapsal | 261/93 |
| 3,984,001 | A | * | 10/1976 | Nagano et al. | 209/3 |
| 4,051,204 | A | * | 9/1977 | Muller et al. | 261/36.1 |
| 4,086,306 | A | * | 4/1978 | Yoshinaga | 261/93 |
| 4,193,949 | A | * | 3/1980 | Naito | 261/87 |
| 4,265,739 | A | * | 5/1981 | Dalton | 209/169 |
| 4,267,052 | A | * | 5/1981 | Chang | 210/629 |
| 4,437,765 | A | * | 3/1984 | Seeger | 366/264 |
| 4,643,852 | A | * | 2/1987 | Koslow | 261/93 |
| 4,696,417 | A | * | 9/1987 | Ugolini | 222/146.6 |
| 5,275,762 | A | * | 1/1994 | Burgess | 261/4 |

FOREIGN PATENT DOCUMENTS

| | | | | |
|---|---|---|---|---|
| GB | 1381130 | * | 1/1975 | 261/93 |

* cited by examiner

*Primary Examiner*—Richard L. Chiesa
(74) *Attorney, Agent, or Firm*—Troxell Law Office PLLC

(57) ABSTRACT

The present invention is an improved structure for an oxygen adding and aeration device includes a pump; a two-layer impeller, which is installed on a top of the pump; a pump case, which covers on outside of the two-layer impeller; an air tube, which is installed in impeller inlets of a lower-layer impeller of the two-layer impeller, a top end of the air tube protrudes out of a water level; when starting the pump, the two-layer impeller is then driven to deliver air from the air tube into the lower-layer impeller, partial water is sucked from filter holes into air tube to mix with air becoming an air-water flow, continuously, the air-water injection flow is injected by the lower-layer impeller and the lower-layer outlet of the pump case to form an air-water injection flow, other partial water is sucked from the impeller inlet of the upper-layer impeller into the air tube, continuously, the water passes through the impeller outlet of the upper-layer and the upper-layer outlet of the pump case to form a water injection flow. Via a high-speed and strong structure of the upper-layer water injection flow guiding the lower-layer air-water injection flow moving forward so as to that the time and the distance of bubbles retaining in water are both raised to increase oxygen in water.

7 Claims, 3 Drawing Sheets

STRUCTURE FOR AN OXYGEN ADDING AND AERATION DEVICE

FIELD OF THE INVENTION

The invention is related to an improved structure for an oxygen adding and aeration device, especially the oxygen adding and aeration device with two-layer impellers and a pump case of two-layer injecting channels. An injected water structure of an upper layer guides injection mixture of water and gas of a lower layer to flow forward, therefore the time and the distance of bubbles retaining in water are both increased for oxygen adding and aeration.

BACKGROUND OF THE INVENTION

Generally, an aquatic farm adopts traditional waterwheels, submersible pumps to increase oxygen in an aquatic pool. Referring to FIG. 1, a pump 10 cooperates with an air tube 20 to suck air (as several dot lines with arrows), meantime pump 10 draws out pool water from water inlet 11 (as a line with an arrow). After mixing of air and water around an impeller 12 of pump 10, impeller 12 injects the mixture into the pool from an outlet 13 of pump 10 via high-speed rotation of impeller 12 (as rectangulars and arc-rectangulars with arrows). Due to bubbles 15 of the mixture floating out of the water level being no oxygen adding function, the rest is injection water 14, thus pump 10 must be in operation continuously to keep generating bubbles 15.

Based on the theory or the practice, bubbles retaining in pool water longer or smaller bubbles causes that bubbles hardly floating out of the water, thus the oxygen in pool water is raised up. To review the patents of Republic of China; 450021, 399405, 474331, 467146 and U.S. Pat. No. 5,275,762, titled "Aerator" and released in 1994, they focus on the points of how to averagely spread bubbles and maintain clean paths for bubbles, on the other hand, the issue for extending the time of bubbles retaining in water is nothing related. Hence, the problem for oxygen adding and aeration is not figured out basically.

SUMMARY OF THE INVENTION

The premier objective of the present invention is to offer an improved structure for an oxygen adding and aeration device. An injected water structure of an upper layer guides injection mixture of water and gas of a lower layer to flow forward, therefore the time and the distance of bubbles retaining in water are both increased for oxygen adding and aeration.

The secondary objective of the present invention is to offer an improved structure for an oxygen adding and aeration device. An air tube guides air into a water pool for mixing air and water, then the dynamics and weight of water bring air down into the water pool; it is then to avoid that air cannot be sucked because of high water pressure, and a deeper water pool is suitable to the present structure.

To further understand and recognize the merits of the present invention, a detailed description matching with corresponding drawings are presented as follows.

DETAILED DESCRIPTION OF THE INVENTION

Figure 1:
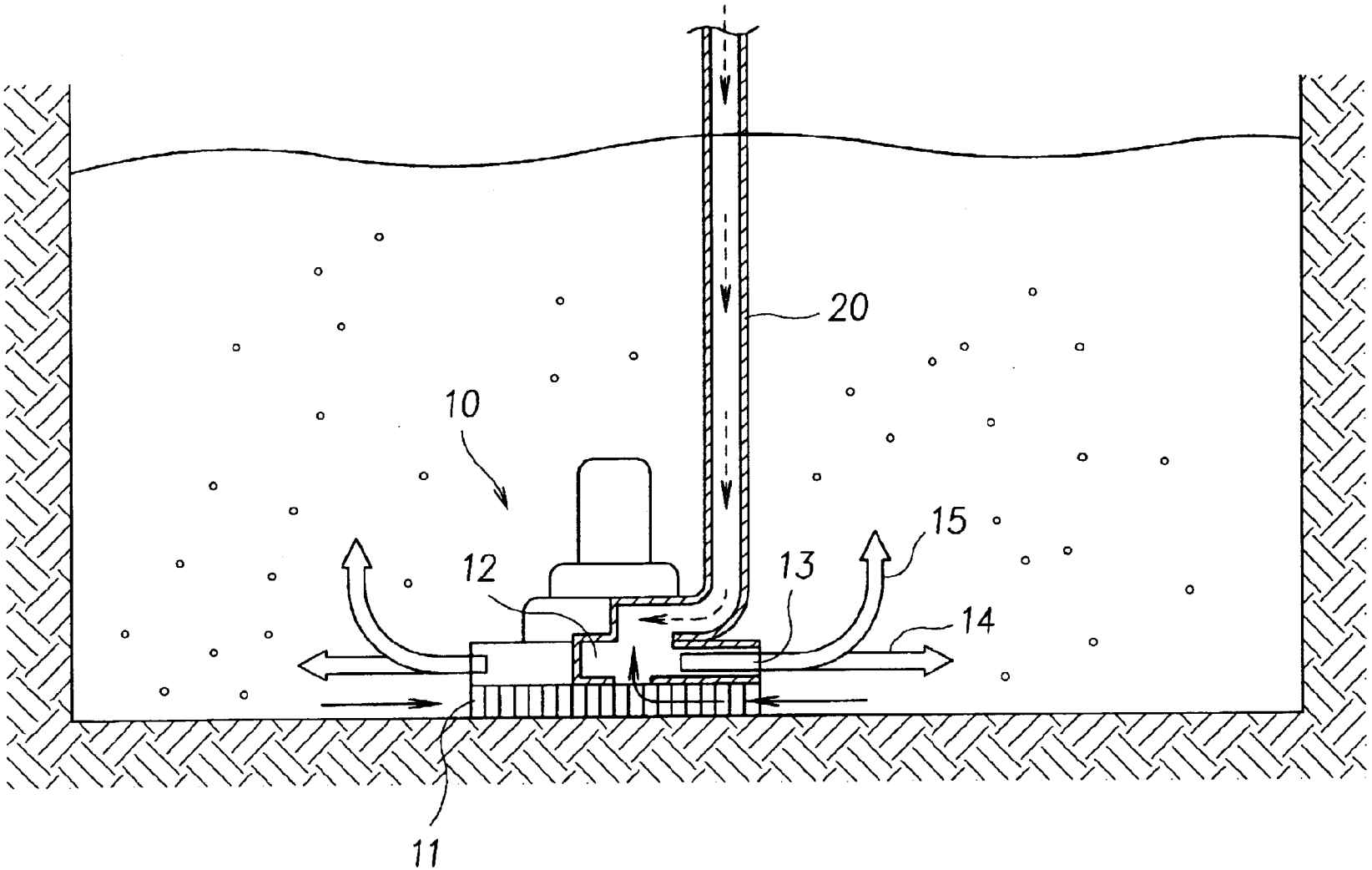
FIG. 1 is an action sketch of an oxygen adding and aeration device in prior arts.
Figure 2:
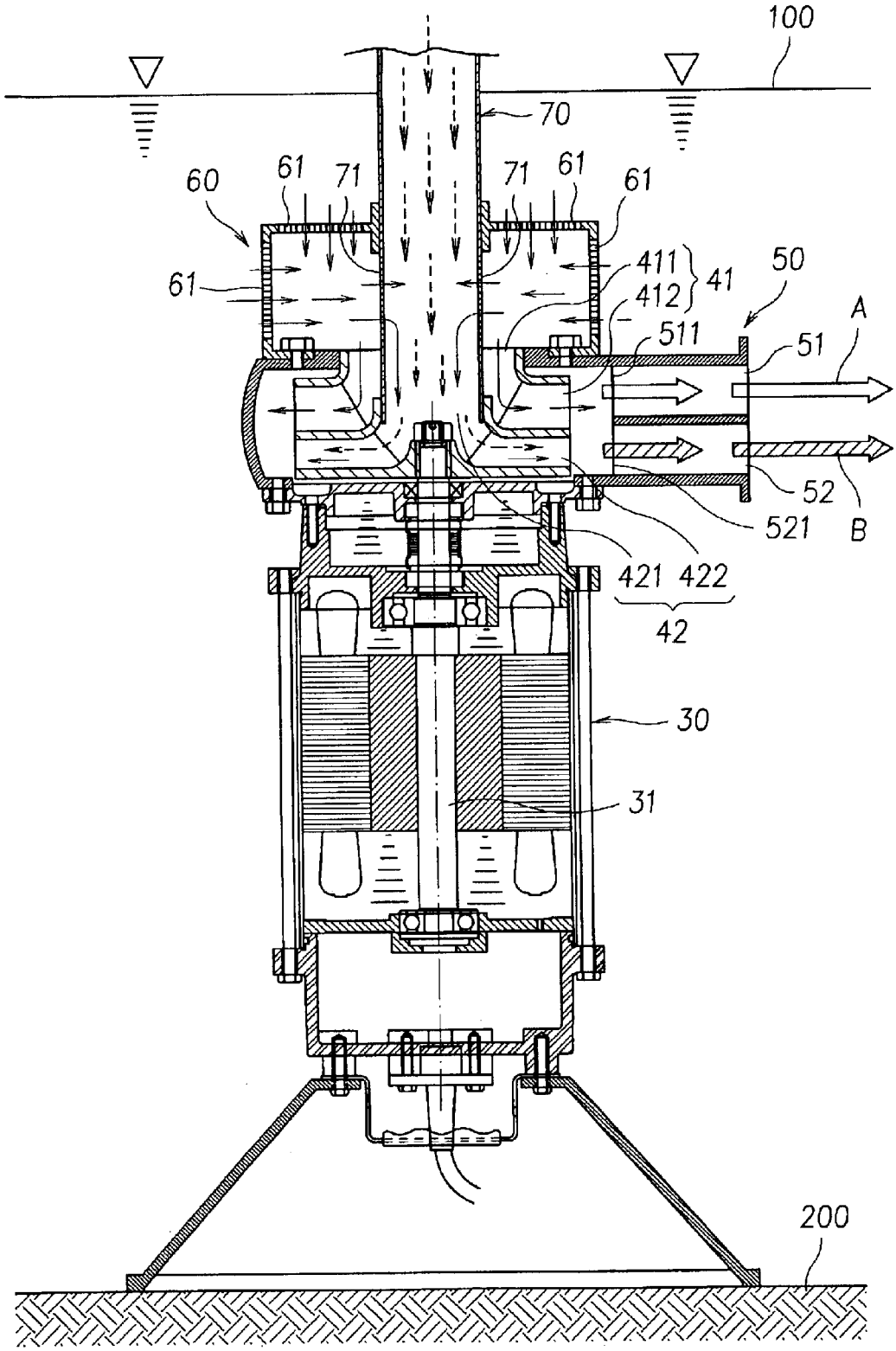
FIG. 2 is a sectional view of a first preferred embodiment of the present invention.

Please refer to FIG. 2, which is a sectional view of a first preferred embodiment of the present invention. The preferred embodiment comprises a pump 30, which is installed in water, and a driving axis 31 of the pump 30 is vertical to a water level 100, generally pump 30 is located on a pool bottom 200 of an aquatic pool; a two-layer impeller, which is installed on a top of pump 30 and has an upper-layer impeller 41 and a lower-layer impeller 42, both impellers have their own impeller inlets 411 and 421 and impeller outlets 412 and 422; a pump case 50, which is installed on top of pump 30 and covers on an outside of the two-layer impeller, the pump case 50 has an upper-layer outlet 51 and a lower-layer outlet 52, the upper-layer outlet 51 is relative to the impeller outlet 412 of the upper-layer 41 of the two-layer impeller, and the lower-layer outlet 52 is relative to the impeller outlet 422 of the lower-layer impeller 42 of the two-layer impeller inside of the pump case 50 corresponding to upper-layer impeller outlet 412 and lower-layer impeller outlet 422 are designed two water-cut angles 511 and 521 to ensure that water and the mixture of water and air exhausted from upper-layer impeller 41 and lower-layer impeller 42 of the two-layer impeller can be injected from upper-layer outlet 51 and lower-layer outlet 52 of pump case 50, in principle, pump case 50 is a volute pump case, therefore from the water-cut angles 511 and 521 to upper-layer outlet 51 and lower-layer outlet 52 is formed as a flat and diffused flow channel; a filter case 60, which is installed on a top of pump case 50 and has plural filter holes 61, inside of the filter case 60 is connected and through to the impeller inlet 411 of upper-layer impeller 41 of the two-layer impeller, filter case 60 functions as a percolator for water entering into impeller inlet 411 of upper-layer impeller 41 and an air tube 70, for the embodiment, filter case 60 completely covers on plural filter holes 71 of the air tube 70, such that, water in the air tube 70 is filtered twice by filter holes 61 and 71 to exclude leaves, excrements, etc.; the air tube 70, which tube wall has a plurality of filter holes 71, bottom of air tube 70 is connected and through to impeller inlet 421 of lower-layer impeller 42 of the two-layer impeller, a top end of air tube 70 protrudes out of a water level 100, further that, by clamping forces of filter case 60, air tube 70 and the two-layer impeller are concentric to ensure smooth operation of the two-layer impeller and without interference.

When starting a pump 30, the two-layer impeller is then driven to deliver air from air tube 70 into lower-layer impeller 42 (as several dot lines with arrows). Partial water is sucked from filter holes 71 into air tube 70 (as several tiny lines with arrows) to mix with air becoming the mixture of water and air, continuously, the mixture is injected by lower-layer impeller 42 and lower-layer outlet 52 of pump case 50 to form an air-water injection flow B. Other partial water is sucked from impeller inlet 411 of upper-layer impeller 41 into air tube 70, continuously, the water passes through impeller outlet 412 of upper-layer 41 and upper-layer outlet 51 of pump case 50 to form a water injection flow A. The water injection flow A is parallel to the air-water injection flow B. Via a high-speed and strong structure of upper-layer water injection flow A guiding lower-layer air-water injection flow B moving forward, hence water injection flow A forms a barrier to air-water injection flow B so that the time and distance of bubbles retaining in water are both raised to increase oxygen in water.

Figure 3:
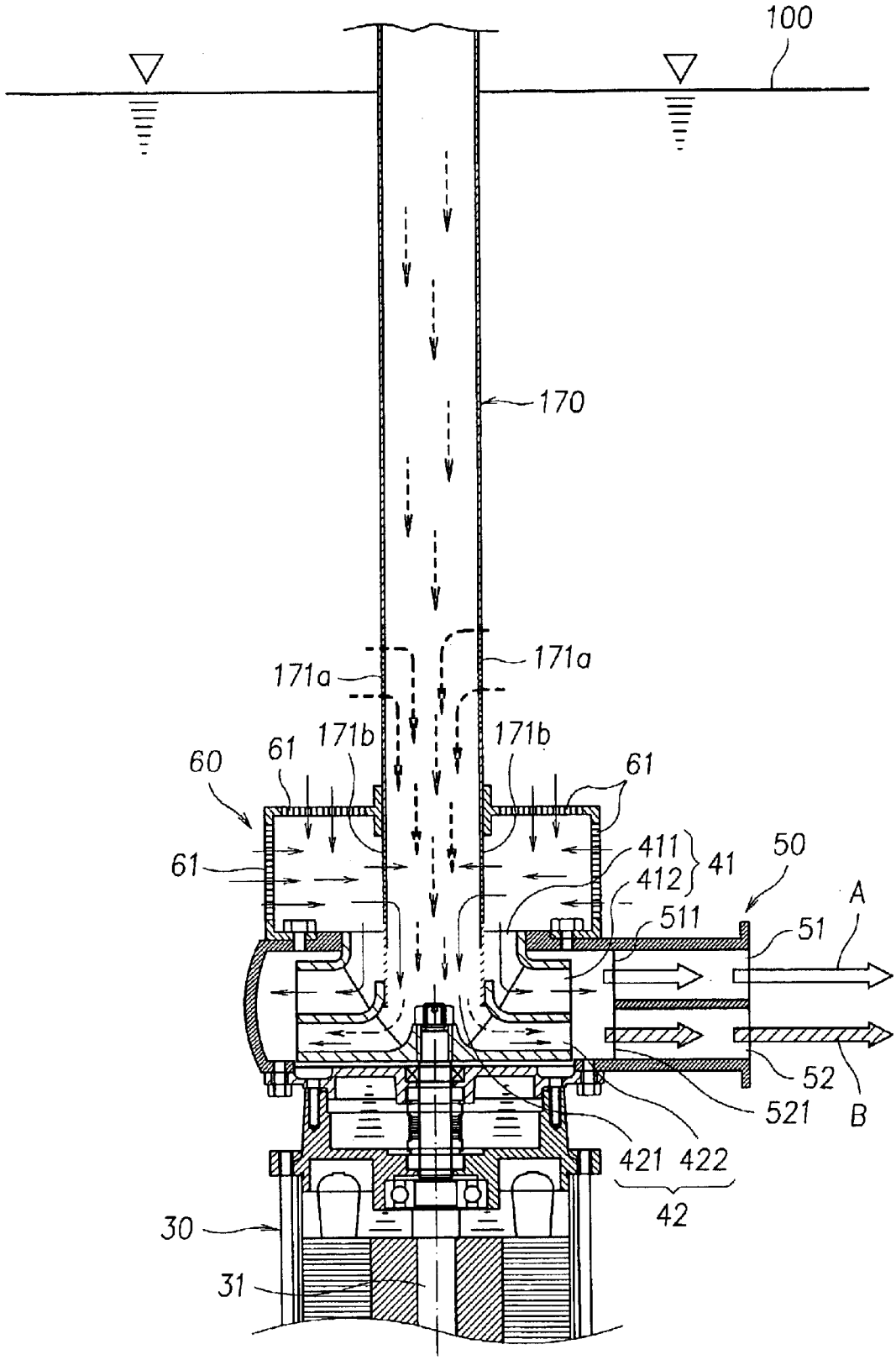
FIG. 3 is a sectional view of a second preferred embodiment of the present invention.

Please refer to FIG. 3, which is a sectional view of a second preferred embodiment of the present invention. The preferred embodiment differing with the first embodiment is that a plurality of filter holes 171 on an air tube 170 is spread wide to result in partial filter holes 171*a* being out of filter case 60 and partial holes 171*b* being within filter case 60. While pump 30 pumping air from an air tube 170 into lower-layer impeller 42 (as several tiny dot lines with arrows), partial water is drawn out from filter holes 171*a* into air tube 170 (as several thick dot lines with arrows), other partial water is then pumped out to pass through filter holes 61, 171*b* and into air tube 170 (as several tiny lines with arrows), meantime, it mixes with air to become an air-water flow, then passes through lower-layer impeller 42, lower-layer outlet 52 of pump 50 to form air-water injection flow B. Other partial water is drawn out from impeller inlet 411 of upper-layer impeller 41, and passes through impeller outlet 412 of upper-layer impeller 41, upper-layer outlet 51 of pump case 50 to form water injection flow A. Both injection flows are parallel each other. The main purpose of the preferred embodiment is that while a water depth is over a certain depth (about 5 meters) and an air tube 170 only has air, therefore air pressure is, not as high as water pressure so that pump 30 cannot pump air into the two-layer impeller. The present embodiment designs that at the moment of pump 30 pumping air, partial water is guided into air tube 170. Via the weight and dynamics of water, air is brought downward, ever to a depth of over 5 meters and can be sucked as well. The amount and height of filter holes 171*a* may depend on the length and diameter of air tube 170; similarly, the present embodiment adopts the high-speed and strong structure of upper-layer water injection flow A to guide lower-layer air-water injection flow B moving forward, thus water injection flow A is as a barrier to air-water injection flow B for the time and distance of bubbles retaining in water so as to raise up the degree of oxygen in water.

As aforesaid, the present invention adopts the high-speed and strong structure of upper-layer water injection flow to guide lower-layer air-water injection flow moving forward, thus water injection flow is as a barrier to air-water injection flow for the time and distance of bubbles retaining in water so as to raise up the degree of oxygen in water. While the present invention has been shown and described with reference to preferred embodiments thereof, and in terms of the illustrative drawings, it should be not considered as limited thereby. Thus, the present invention is infinitely used. However, various possible modification, omission, and alterations could be conceived of by one skilled in the art to the form and the content of any particular embodiment, without departing from the scope and the sprit of the present invention.

The invention is disclosed and is intended to be limited only by the scope of the appended claims and its equivalent area.

what is claimed is:

1. An improved structure for an oxygen adding and aeration device comprising:

a pump;

a two-layer impeller having an upper-layer impeller and a lower-layer impeller, both impellers having their own impeller inlets and impeller outlets;

a pump case having an upper-layer outlet and a lower-layer outlet;

an air tube having a plurality of filter holes on a tube wall thereof;

the pump being installed in water and a driving axis of the pump being vertical to a water level, the two-layer impeller being installed on a top of the pump, the pump case being installed on the top of the pump and covering on an outside of the two-layer impeller, the upper-layer outlet of the pump case being relative to the impeller outlet of the upper-layer impeller of the two-layer impeller, and the lower-layer outlet being relative to the impeller outlet of the lower-layer impeller of the two-layer impeller, a bottom of the air tube connecting and through to the impeller inlet of the lower-layer impeller of the two-layer impeller, a top end of the air tube protruding out of a water level when starting the pump, the two-layer impeller being then driven to deliver air from the air tube into the lower-layer impeller, partial water being sucked from filter holes into the air tube to mix with air becoming an air-water injection flow, other partial water being sucked from the impeller inlet of the upper-layer impeller and passing through the impeller outlet of the upper-layer impeller and the upper-layer outlet of the pump case to form a water injection flow; via a high-speed and strong structure of the upper-layer water injection flow guiding the lower-layer air-water injection flow moving forward so that a time and a distance of bubbles retaining in water being both raised to increase oxygen in the water.

2. The improved structure for an oxygen adding and aeration device as recited in claim 1, wherein a filter case is installed on a top of the pump case, inside of the filter case is connected and through to the impeller inlet of the upper-layer impeller of the two-layer impeller, the filter case functions as a percolator for water entering into the impeller inlet of the upper-layer impeller and the air tube.

3. The improved structure for an oxygen adding and aeration device as recited in claim 2, wherein the filter case is installed around plural filter holes of the air tube and completely covers on plural filter holes of the air tube, such that, water in the air tube is filtered twice.

4. The improved structure for an oxygen adding and aeration device as recited in claim 2, wherein the filter case is installed around plural filter holes of the air tube, partial filter holes are out of the filter case and partial filter holes are within the filter case, such that, water sucked into the air tube is then percolated twice, other water is pumped into the air tube via the filter holes, which are out of the filter case, and thus air in the air tube is brought downward by way of dynamics of water.

5. The improved structure for an oxygen adding and aeration device as recited in claim 1, wherein inside of the pump case corresponding to the upper-layer impeller outlet and the lower-layer impeller outlet are designed two water-cut angles to ensure that water injection flow and air-water injection flow exhausted from the upper-layer outlet and the lower-layer outlet of the pump case.

6. The improved structure for an oxygen adding and aeration device as recited in claim 1, wherein the air tube is concentric to the two-layer impeller.

7. The improved structure for an oxygen adding and aeration device as recited in claim 1, wherein the pump case is a volute pump case, therefore from water-cut angles to the upper-layer outlet and the lower-layer outlet is formed as a flat and diffused flow channel.

* * * * *